US012281452B2

(12) United States Patent
Parrott et al.

(10) Patent No.: US 12,281,452 B2
(45) Date of Patent: Apr. 22, 2025

(54) HIGH SPEED HIGH PERFORMANCE DELINEATOR SYSTEM

(71) Applicant: Impact Recovery Systems, Inc., San Antonio, TX (US)

(72) Inventors: Kenneth Parrott, Helotes, TX (US); Gregory L. Hannah, San Antonio, TX (US)

( * ) Notice: Subject to any disclaimer, the term of this patent is extended or adjusted under 35 U.S.C. 154(b) by 836 days.

(21) Appl. No.: 17/604,427

(22) PCT Filed: May 19, 2020

(86) PCT No.: PCT/US2020/033516
§ 371 (c)(1),
(2) Date: Oct. 17, 2021

(87) PCT Pub. No.: WO2020/236770
PCT Pub. Date: Nov. 26, 2020

(65) Prior Publication Data

US 2022/0275592 A1 Sep. 1, 2022

Related U.S. Application Data

(60) Provisional application No. 62/850,949, filed on May 21, 2019.

(51) Int. Cl.
*E01F 9/60* (2016.01)
*E01F 9/627* (2016.01)

(52) U.S. Cl.
CPC ..... *E01F 9/629* (2016.02)

(58) Field of Classification Search
CPC ..... E01F 9/629; E01F 9/658; E01F 9/677
See application file for complete search history.

(56) References Cited

U.S. PATENT DOCUMENTS

| | | | | | |
|---|---|---|---|---|---|
| 1,337,947 | A * | 4/1920 | O'Toole | E01F 9/627 | 40/608 |
| 4,240,766 | A * | 12/1980 | Smith | E01F 9/594 | 40/607.05 |
| 4,373,464 | A * | 2/1983 | Blau | E01F 9/627 | 116/63 R |
| 4,511,281 | A * | 4/1985 | Schmanski | E01F 9/629 | 404/10 |
| 4,515,499 | A * | 5/1985 | Furiate | E01F 9/529 | 404/6 |
| 6,887,142 | B2 * | 5/2005 | Rupprecht | B24B 45/006 | 451/508 |
| 9,717,974 | B2 * | 8/2017 | Hahn | A63B 71/023 | |
| 2018/0313107 | A1 * | 11/2018 | McDowell | E04B 5/026 | |
| 2019/0368140 | A1 * | 12/2019 | Wiesman | E01F 9/677 | |

FOREIGN PATENT DOCUMENTS

| | | | | |
|---|---|---|---|---|
| GB | 2084226 A * | 4/1982 | | E01F 9/677 |
| GB | 2533551 A * | 6/2016 | | E01F 13/026 |

* cited by examiner

*Primary Examiner* — Gary S Hartmann
(74) *Attorney, Agent, or Firm* — Miguel Villarreal, Jr.; Gunn, Lee & Cave, P.C.

(57) ABSTRACT

A traffic delineator system having a flexible delineator body member, a base member, a cylindrical load-collar attached to the body member at a first end and having a second end with rigid tapering threaded shoulder members to be releasably interlocked within a receiving space in the base member. The collar has tapering side walls with a varying thickness from a first end to a second end.

3 Claims, 5 Drawing Sheets

HIGH SPEED HIGH PERFORMANCE DELINEATOR SYSTEM

This utility patent application claims priority to U.S. Provisional Patent Application Ser. No. 62/850,949 filed May 21, 2019, and to International PCT Application No. PCT/US20/33516 filed 2020 May 19, which are incorporated herein for all purposes.

FIELD OF THE INVENTION

This invention relates generally to delineator posts for use in delineating boundaries and hazards, such as marking the alignment of a travel way, the existence of a hazardous location, or the existence of a hazardous object. More specifically, the present invention relates to a delineator post system construction which facilitates pivoting from a normally aligned, upright post position to a substantially horizontal position upon being impacted by an object moving at a high speed (approximately 70 mph) such as an automotive vehicle. Even more specifically, this invention relates to a self up-righting delineator post constructed with a unique flexion collar member that minimizes damage to the automotive vehicle and the post when such accidental striking occurs at high speeds.

BACKGROUND OF THE INVENTION

Delineator posts for marking travel ways and identifying the existence of hazardous objects are typically constructed of lengths of formed metal sheet material or bar stock which are concreted or otherwise fixed to the ground or to other stationary objects. Such posts are typically provided with light reflectors to facilitate identification at night and are appropriately colored for good visibility during daylight hours. It is well known that delineator posts are frequently accidentally struck by automotive vehicles that for one reason or another leave the designated travel way. Once struck, the delineator posts are typically bent to the extent that they are thereafter unusable. Additionally, because the posts are somewhat rigid, there is a likelihood that the automotive vehicle will also be damaged by impact with a delineator post. The replacement cost of delineator posts is a major expense of travel way maintenance. It is desirable therefore to provide a delineator post construction that will not be destroyed upon impact by a moving automotive vehicle, particularly at high speeds, and which is likely to cause no damage to the automotive vehicle as the result of accidental collision. Consequently, it is desirable to provide a delineator post construction which will yield when impacted by an automotive vehicle and which, after passage of the automotive vehicle, will return to its upright position in a substantially undamaged condition.

Most delineator posts are permanently mounted at specific locations, such as being concreted in the ground, epoxied to stationary objects, driven into the ground, etc. In the event the position of these posts needs to be changed the posts must be removed and replaced at the cost of significant material and labor. Moreover, there is no arrangement readily available for situations where delineator posts need to be periodically located for specific traffic conditions. It is desirable therefore to provide self up-righting delineator posts that may be quickly and efficiently installed and may be removed and replaced as needed with minimal labor and material costs.

THE PRIOR ART

Generally flexible and self up-righting delineator posts are known in the prior art. These include examples disclosed in U.S. Pat. Nos. 4,092,081; 4,084,914; 4,092,081; 4,123,183; 4,343,567; and 4,806,046. FIG. 1 of the present disclosure illustrates a delineator system of the prior art having an attachment mechanism at the lower end of the post body which cooperates with a retention mechanism in a base. The base is to be fixed to a suitable stationary object such as a highway, road, or other support structure. The high speed, high performance delineator system of the present invention is a significant improvement of the prior art illustrated in FIG. 1 as will be described below.

SUMMARY OF THE INVENTION

It is a feature of the present invention to provide a self up-righting delineator system construction that meets MUTCD specifications and is capable of being struck many times at impact speeds of 70 mph without significant damage and without causing damage to automotive vehicles during such accidental striking.

It is also a feature of the present invention to provide a novel construction having a cylindrical load collar member adapted to be releasably interlocked with a receiving space within a base member. The load collar bends or flexes upon vehicular impact and rebounds when the impact is over.

It is another feature of this invention for the collar member to have rigid helically-threaded shoulders engageable with cooperating helically-threaded members in the receiving space in the base.

BRIEF DESCRIPTION OF THE DRAWINGS

In order that the manner in which the above recited advantages and features of this invention are attained and can be understood in detail, a more particular description of the invention, briefly summarized above, may be had by reference to the specific embodiments thereof that are illustrated in the appended drawings, which drawings form a part of this specification.

It is to be noted, however, that the appended drawings illustrate only typical embodiments of the invention and are therefore not to be considered limiting of its scope, for the invention may admit to other equally effective embodiments.

FIG. 5A illustrates a perspective view of the collar and the base before engagement.

FIG. 5B shows the collar initially engaging the base.

FIG. 5C illustrates the collar being partially rotated into the base with the collar shoulders interlocking with the helically threaded members in the base receiving space.

FIG. 5D illustrates the post with collar fully rotated one-quarter turn and interlocking with the base member; the safety alignment pin has been urged into a locking position.

DETAILED DESCRIPTION OF PREFERRED EMBODIMENTS

Figure 1:
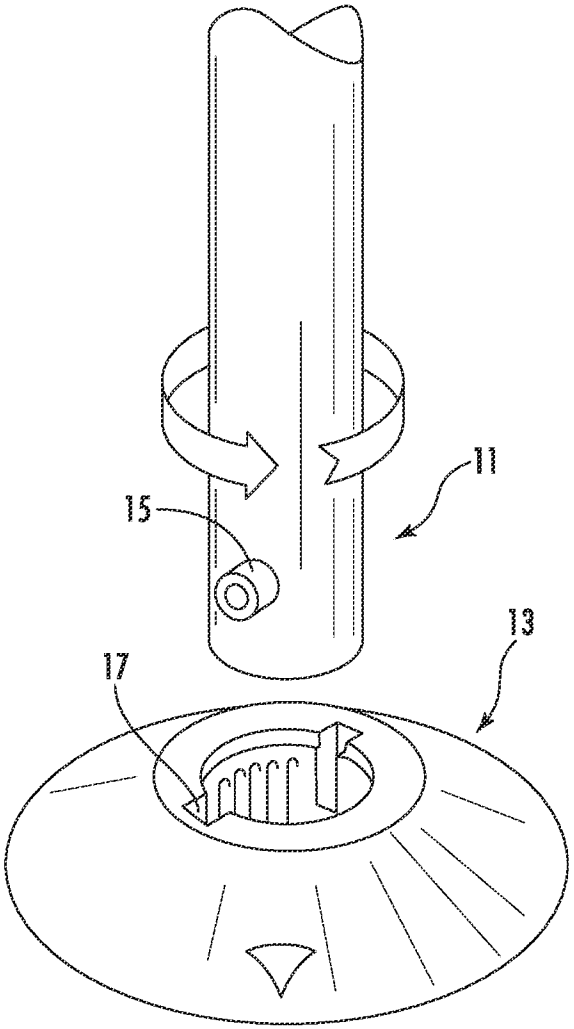
FIG. 1 (PRIOR ART)
FIG. 1 is a perspective view of a prior art embodiment.

Referring now to the drawings and first to FIG. 1, a prior art delineator system is illustrated. The two-piece system consists of a flexible, post 11 and a base 13, which may be secured to the pavement or highway surface. The post 11 is inserted and secured into the base by a twist lock peg 15 projecting horizontally from the post section 11 which engages with a detent 17 in the base.

Figure 2B:
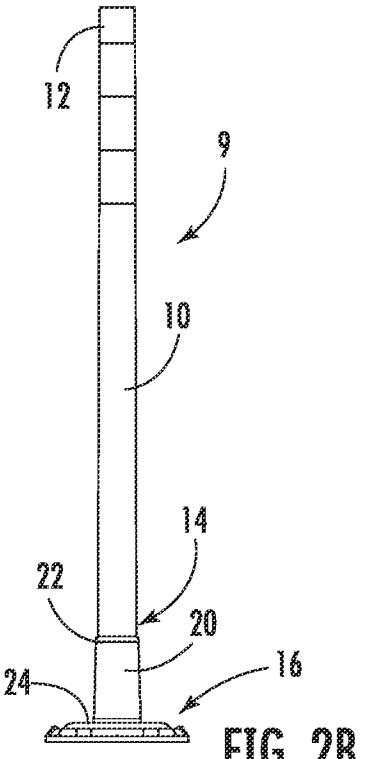
FIG. 2B illustrates a front elevation view of the system of FIG. 2A.
Figure 2C:
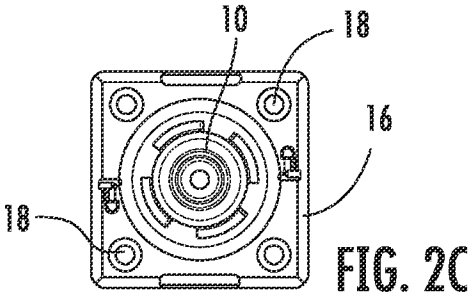
FIG. 2C is a top view of the system of FIG. 2A.
Figure 2A:
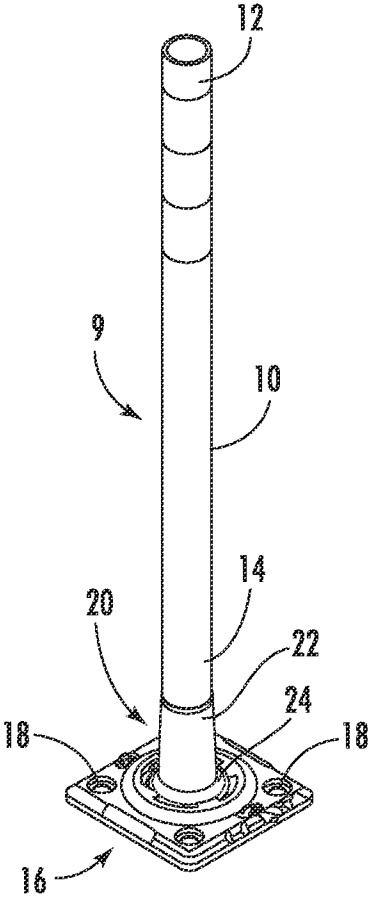
FIG. 2A is a front perspective view of the system of the present invention.

Turning to FIG. 2A the present delineator system is illustrated in a perspective view. As may be seen in FIG. 2A, a traffic delineator system 9 of the present invention includes a flexible, plastic post body 10 that is resistant to ultraviolet light, ozone, and hydrocarbons. The body 10 height may be changed to varying heights by welding any length extruded tube to the load collar 20. For example the body may be 27", 36", or 42" in height. The body 10 has an upper end 12 and a lower end 14.

The system 9 further has a base member 16 for supporting and retaining the body member 10 in a normally upstanding position as illustrated in FIG. 2A. The base member may be fixed to any suitable stationary object as is well known in the art.

FIG. 2A further illustrates that a cylindrical load collar 20 is attached at a first end 22 to the lower end 14 of the body member 10. The collar has a second end 24 which is received into the base member 16. Cylindrical collar 20 is constructed from a high strength, flexible, resilient polymer.

FIG. 2B illustrates the system 9 in an elevation view showing preferable measurements for a 42" high delineator.

FIG. 2C is a top view of the system 9 with the body member 10 and the collar 20 inserted into a receiving space in the base member 16. Openings 18 in are intended to accept fasteners (not shown) to mechanically affix the base to a support surface as would be understood in the art.

Figure 3D:
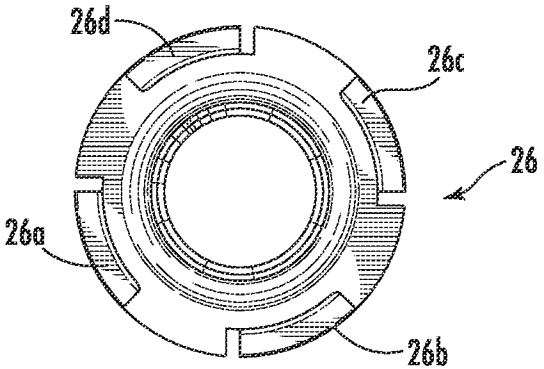
FIG. 3D is a bottom view of the collar of FIG. 3A.
Figure 3E:
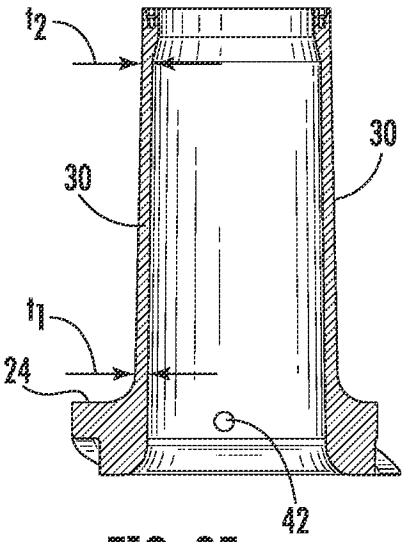
FIG. 3E is a cross-sectional view of the collar of FIG. 3A taken along line A-A of FIG. 3A.
Figure 3C:
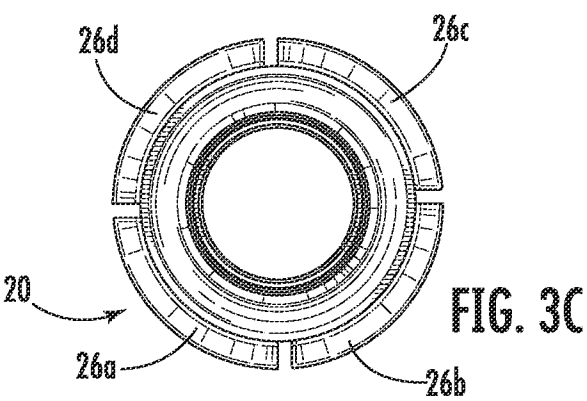
FIG. 3C is a top view of the collar of FIG. 3A.
Figure 3B:
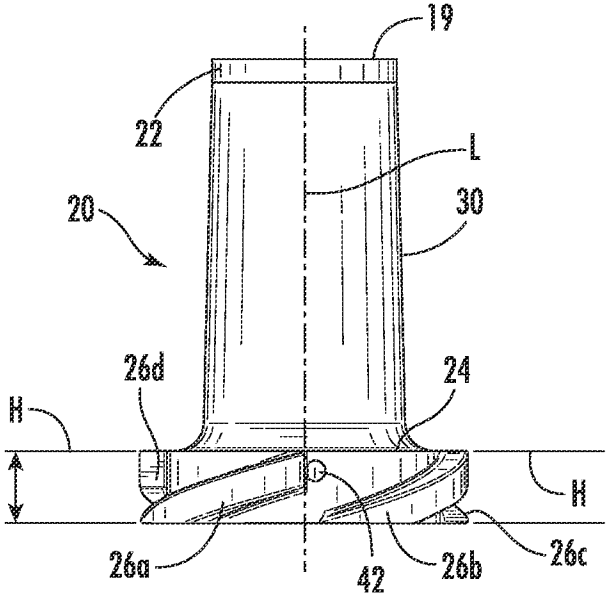
FIG. 3B is an elevation view of the collar of FIG. 3A.
Figure 3A:
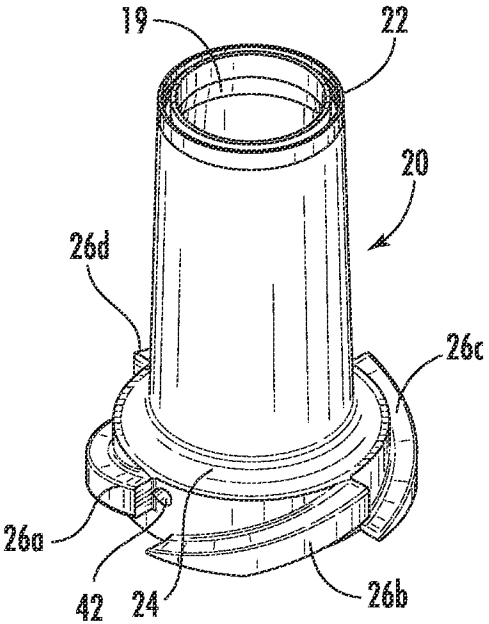
FIG. 3A is a perspective view of the collar member of the present invention.

Turning to FIGS. 3A-3E, details of the cylindrical load collar may be seen. FIG. 3A illustrates the collar 20 in a perspective view. The top or first end 22 of the collar 20 is attached to the lower end 14 of the body member 10 forming a nearly integral unit. This connection may be a spin weld. A welded single material composition (or welded compatible material) construction of collar to post body eliminates any attachment hardware that typically snags on vehicles while allowing for any height above the spring portion (i.e., still extruded tube whereas prior art are generally single piece injection molded, thus limiting various lengths of tooling). The collar 20 is provided with a flanged shear joint 19 to accept the extruded post body 10 and to protect from vehicle snagging.

The lower or second end 24 of the collar 20 is provided with multiple rigid, helically-threaded shoulders 26*a*-26*d* which are intended to be releasably interlocked within the receiving space 21 in the base member 16 with cooperating helically-threaded interlocking/receiving members 23 along the inner walls of the receiving space. The helical tapered shoulders allow for holding the collar 20 in the base member 16 without pins or other metal plates. The cooperation of the shoulders with the interlocking base members results in a greater contact area of the collar with the base thereby spreading forces and allowing the flexible material to still hold from pull out forces. FIG. 3A shows an anti-rotation pin orifice 42 in the collar 20 behind shoulder 26*a*. The orifice 42 function will be described below.

FIG. 3B is an elevation view of collar member 20 showing preferred measurements of the collar. FIG. 3B illustrates an inner longitudinal axis L extending vertically through the collar and a horizontal axis H for the collar.

Figure 6:
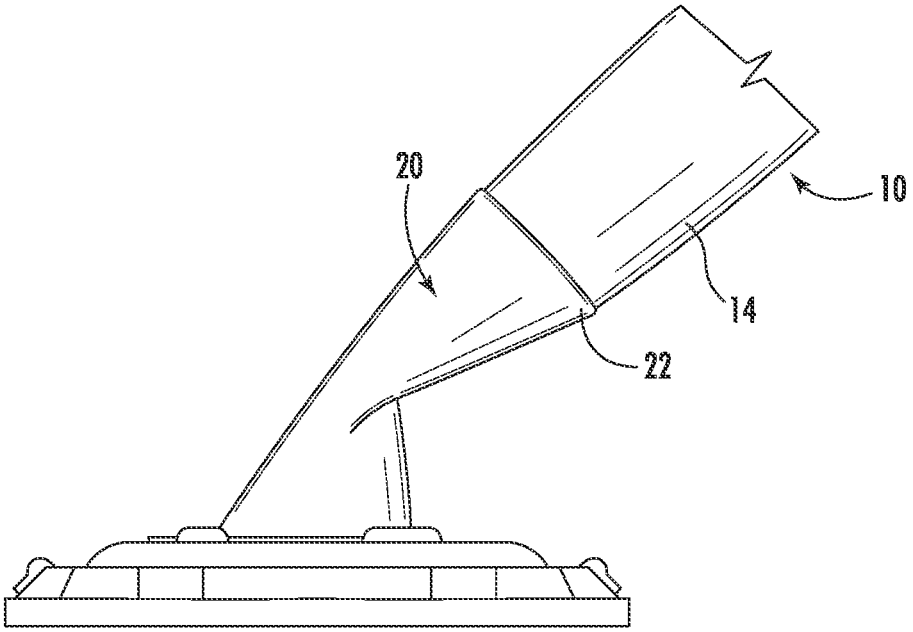
FIG. 6 illustrates the bending or flexion of the load collar upon vehicular impact with the delineator post.

It should be noted that side walls 30 taper in the range of 1° to 5° from the horizontal axis H toward the inner longitudinal axis L (See FIG. 3B). Further, as seen in FIG. 3E, the side walls 30 have a first thickness $t_1$ greater at the second end 24 of the collar than a second wall thickness $t_2$ at the first end of the collar member. This varying wall thickness facilitates the controlled-flexion of the collar upon impact. FIG. 6 shows the flexion of the collar 20 upon a vehicular impact to the system 9 on the post 10. The first thickness may be in the range of 0.150" to 0.170" and the second thickness may be in the range of 0.125" to 0.140".

The tapered collar 20 and the tapered side walls 30 eliminate the need for kicker tubes and other alternate hinges to rebound the delineator as is common prior art in the industry.

FIG. 3C is a top view of the collar showing the four tapering, helically-threaded shoulders 26*a*-26*d*. FIG. 3D is a bottom view of the collar member. FIG. 3E is a cross-sectional view of the collar taken along line A-A in FIG. 3C showing the tapering wall thickness $t_1$ and $t_2$ of collar 20.

Figure 4A:
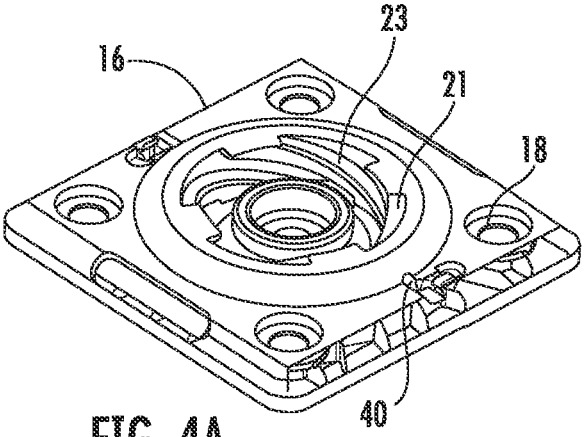
FIG. 4A is a front, top perspective view of the base member of the present inventive system.

FIG. 4A is a perspective view of base member 16 showing the cooperating helically-threaded receiving/interlocking members 23 along the inner walls of the receiving space 21. Fastener openings 18 are also shown and would be understandable to one of ordinary skill in the art.

Figure 4B:
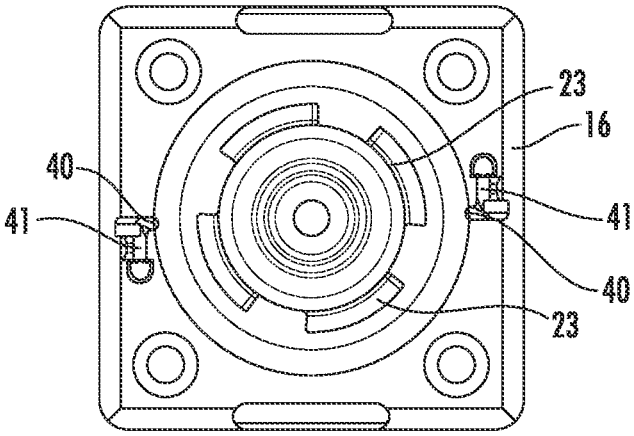
FIG. 4B is a top view of the base member of FIG. 4A.

FIG. 4B is a top view of the base member 16 showing preferred measurement of the elements of the base. A safety alignment pin 41 may be urged into locking orifice 40 in the base as described further below. The pin 41 not only allows for alignment of the components, but functions as an anti-rotational locking pin that does not experience a vertical pull out load or need to resist vertical forces that may pull the collar 20 out of the base 16.

Figure 4C:
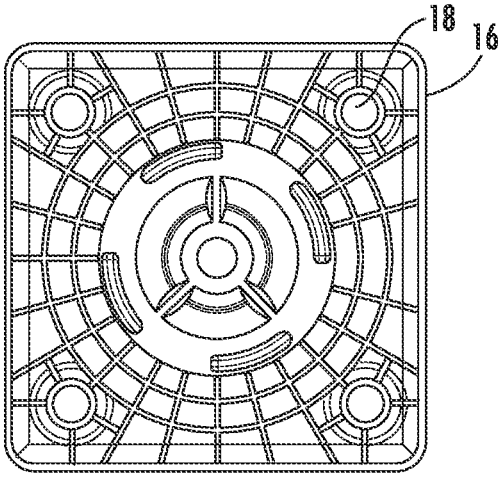
FIG. 4C is a bottom view of the base member of FIG. 4A.

FIG. 4C illustrates the bottom of the base 16 with numerous channels for an adhesive to fill when the base is affixed to a supporting surface.

Figure 4D:
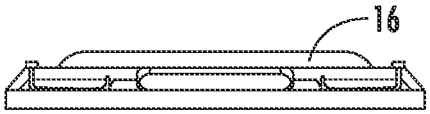
FIG. 4D is a front elevation view of the base member of FIG. 4A.
Figure 4E:
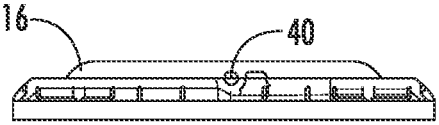

FIGS. 4D and 4F are side elevation views of the base with FIG. 4F showing a safety alignment pin orifice 40.

FIGS. 5A through 5D illustrate the cooperation of the helically-threaded shoulders 26*a*-26*d* on the collar 20 with the helically-threaded receiving members 23 along the inner side walls of the base receiving space in the base member.

Figure 5A:
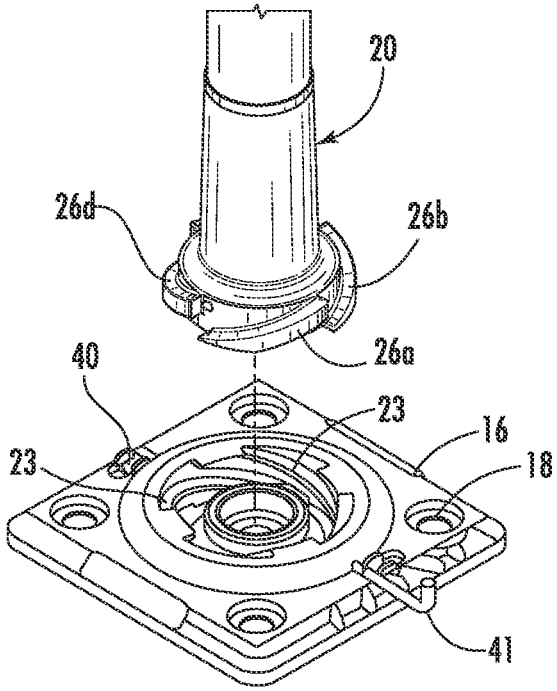
FIGS. 5A-5D illustrate the cooperation of the structural elements of the present invention as the post with the collar is engaged and interlocks with base member.

FIG. 5A shows a perspective view of the collar and base before engagement. The helically-threaded shoulders 26*a*-26*d* are urged downwardly in to the base and engage with the receiving members along the inner side walls.

Figure 5B:
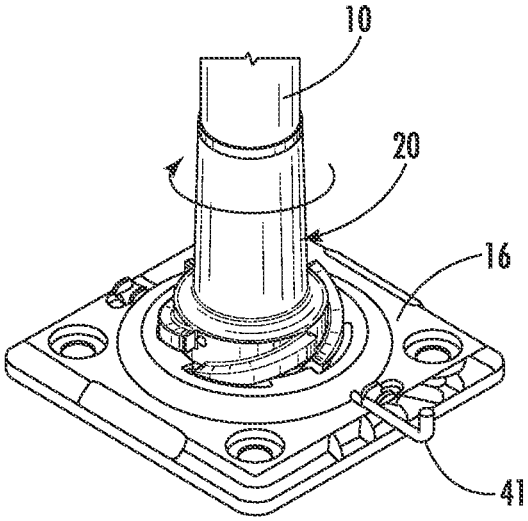
Figure 5C:
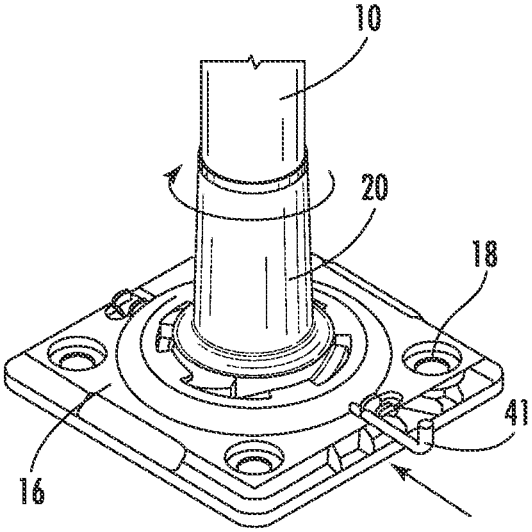
Figure 5D:
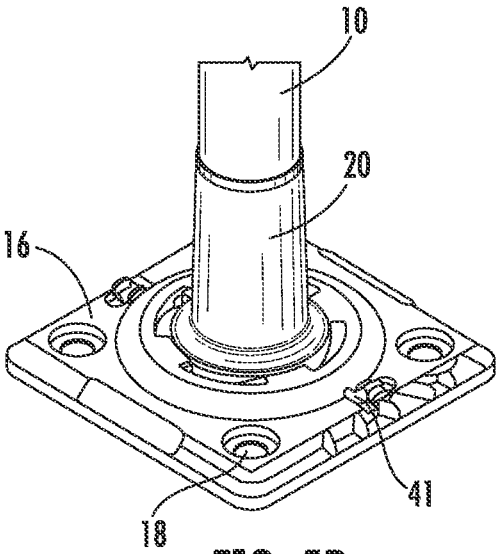

FIG. 5B shows the collar and shoulders initially engaging the base as the collar is rotated into interlocking position. FIG. 5C shows further engagement. FIG. 5D illustrates the post with collar 20 fully rotated one-quarter turn and interlocking with the base member 16. The alignment/anti-twist pin 41 passes through orifice 40 in the base 16 and passes into the locking port 42 in the collar and adjacent to the end of shoulder 26*a* of the collar 20.

FIG. 6 shows the unique load collar 20 flexing or bending when the system 9 is impacted. Normally, the collar 20 is in an upright, vertical position as shown in FIGS. 2A and 2B. Upon vehicular impact the post 10 is urged downwardly upon such impact, and the construction of the collar 20, as described above in FIGS. 3A thru 3E, allows the collar to flex and then rebound upon cessation of the impact. Once the impact is over, the system returns to its upright position as seen in FIGS. 2A and 2B.

It is therefore clearly evident that the present invention is one well adapted to obtain all of the objects and advantages hereinabove set forth together with other objects and advantages that are inherent from a description of the apparatus itself.

It will be understood that certain combinations and sub-combinations are of utility and may be employed without reference to other features and sub-combinations. This is contemplated by and is within the scope of the present invention.

As many possible embodiments may be made of this invention without departing from the spirit and scope thereof it is to be understood that all matters hereinabove set forth or shown in the accompanying drawings are to be interpreted as illustrative and not in any limiting sense.

We claim:

1. A traffic delineator post system comprising:

a flexible delineator body member having an upper and a lower end;

a base member for supporting and retaining said body member and adapted to be fixed to any suitable stationary object and having a threaded receiving space therein; and a high strength, flexible, resilient cylindrical collar member attached at a first end to said lower end of said body member and a second end of said collar member adapted to be releasably interlocked within said receiving space in said base member, said collar member having an inner longitudinal axis and side walls angularly tapering at an angle in the range of 1-5 degrees from a horizontal axis of said collar member toward said inner longitudinal axis, and at least four tapering, rigid, helically threaded shoulders at said second end of said collar member and adapted to be releasably interlocked within said receiving space in said base member; wherein said collar member and said side walls have a first thickness $t_1$ greater at said second end of said collar member than a second wall thickness $t_2$ at said first end of said collar member; and wherein said collar member being capable of flexing from a first upright position upon vehicular impact to said system and rebounding to said first upright position upon cessation of said impact.

2. The high speed high performance delineator system of claim 1 wherein said helically-threaded shoulders may be urged downwardly into said base and engage with said receiving members along said inner side walls.

3. The high speed high performance delineator system of claim 2 wherein rotation of said collar releasably interlocks said helically-threaded shoulders with said receiving members along said inner side walls.

* * * * *